United States Patent [19]

Pettit et al.

[11] 4,246,513

[45] Jan. 20, 1981

[54] FLASH LAMP DISCHARGE USING RADIANT ENERGY

[75] Inventors: Clifton S. Pettit, Webster; Robert B. Edwards, Rochester, both of N.Y.

[73] Assignee: Eastman Kodak Company, Rochester, N.Y.

[21] Appl. No.: 872,717

[22] Filed: Jan. 26, 1978

[51] Int. Cl.[2] ..... H05B 41/30

[52] U.S. Cl. ..... 315/150; 315/173; 315/176; 315/241 R

[58] Field of Search ..... 315/149, 150, 171, 176, 315/241 R, 267, 344, 347, 248, 173, 175; 313/100

[56] References Cited

U.S. PATENT DOCUMENTS

| | | | |
|---|---|---|---|
| 1,961,708 | 6/1934 | Penning et al. . | |
| 2,692,948 | 10/1954 | Lion | 315/150 X |
| 2,923,853 | 2/1960 | Engelbart | 315/84.6 |
| 2,931,948 | 4/1960 | Forgacs | 315/241 P |
| 3,071,730 | 1/1963 | Piepenburg | 328/5 |
| 3,350,602 | 10/1967 | Germeshausen et al. | 315/150 |
| 3,398,322 | 8/1968 | Guenther | 315/150 |
| 3,422,307 | 1/1969 | Langer | 315/150 |
| 3,509,421 | 4/1970 | Holz | 315/150 |
| 3,526,807 | 9/1970 | Barbini | 315/150 |
| 3,551,738 | 12/1970 | Young | 315/171 |
| 3,742,281 | 6/1973 | McInally | 315/267 X |
| 3,980,923 | 9/1976 | Schneider | 315/241 P |
| 4,063,132 | 12/1977 | Prood et al. | 315/248 |

*Primary Examiner*—Eugene R. LaRoche

*Attorney, Agent, or Firm*—D. M. Woods

[57] ABSTRACT

Method and apparatus are disclosed for triggering a flash lamp without the use of a conventional high voltage trigger pulse. In accordance with the invention, gas molecules in the flash lamp are ionized by the application of radiant energy to lower the impedance of the flash lamp. An energy discharge device (e.g., a capacitor) is thus able to discharge abruptly through the flash lamp causing the lamp to flash.

16 Claims, 6 Drawing Figures

FLASH LAMP DISCHARGE USING RADIANT ENERGY

BACKGROUND OF THE INVENTION

1. Field of the Invention

The present invention relates to a method for discharging a flash lamp and, more particularly, to such a method wherein the flash lamp discharge is triggered by radiant energy.

2. Description Relative to the Prior Art

A standard flash lamp cmprises a pair of electrodes sealed in a glass or quartz envelope which is filled with an inert gas such as xenon, krypton, neon, etc. As the lamp is flashed, ions and electrons bombard the electrodes and cause electrode material to be scattered and deposited on the inner surface of the lamp envelope. Blackening of the envelope occurs which reduces the light output and increases the electrical impedance of the lamp. The flash lamp eventually fires irregularly and, finally, fails to fire at all. This cause of flash lamp failure, which is one of the more common and more serious causes, is commonly termed "electrode sputtering".

Electrode sputtering is a major problem in flash lamps that are operated with series-injection triggering, especially when the flash lamp is repetitively pulsed. This form of triggering employs a high voltage pulse applied directly to the lamp electrodes. The high voltage pulse ionizes a conduction path between the lamp electrodes, thus lowering the impedance of the flash lamp. A lower voltage but higher energy pulse immediately follows the trigger pulse and produces the lamp flash. As might be expected, arcing a high voltage pulse (commonly on the order of 20–30 kv) between the lamp electrodes places severe stress on the electrodes and often leads to early lamp failure.

To reduce stress on the electrodes, the flash lamp may be triggered externally by means of a trigger wire placed in close proximity to the lamp envelope (it may, for example, be wrapped around the envelope). A high voltage pulse is applied to the trigger wire causing some ionization to take place within the lamp. As before, a lower voltage but higher energy pulse is then applied to the lamp electrodes to produce the flash output.

External triggering, however, is not without problems. Because a high voltage pulse (on the order of 30 kv) is applied to an external trigger wire, spurious arcing can occur between the trigger wire and other components of the flash lamp apparatus such as the lamp electrodes, grounded metal parts, mounting hardware, etc. Also, the high voltage can cause discoloration of the lamp envelope thereby reducing the useful light output of the flash lamp. External triggering is also less reliable than series-injection triggering, particularly for lower trigger voltages. Lastly, the external trigger wire is physically cumbersome and requires that special provision be made for its placement in the lamp housing.

More recently, flash lamps have been operated in what has been termed a "simmer" or "keep alive" mode of operation which requires the addition of a simmer power supply connected in parallel to the flash lamp. The flash lamp is triggered by conventional means (i.e., a high voltage trigger pulse) to allow the simmer power supply to establish a low current dc arc of about 20–100 ma between the flash lamp electrodes. The simmer arc is of insufficient current to provide useful light output, its purpose being to maintain a low impedance, ionized conduction path between the lamp electrodes. To flash the lamp, a switching circuit applies the flash voltage to the lamp electrodes. Because the ionized conduction path provides a low impedance path for the flash voltage, the lamp fires without additional triggering. An advantage of the simmer mode of operation is that the simmer arc is not extinguished upon firing of the flash lamp. The flash lamp can therefore be operated in a pulsed mode by repetitively applying the flash voltage. Since the high voltage trigger pulse is employed only once to initiate the simmer arc, lamp life is significantly increased.

The simmer mode of operation suffers certain disadvantages, however, in that maintenance of a simmer arc in the flash lamp consumes additional power and generates more heat. Additional cooling apparatus is therefore required to maintain the flash lamp at the proper temperature. Under actual operation conditions, the simmer arc may be accidentally extinguished for various reasons, such as excessive heat build-up in the flash lamp. When the simmer arc is extinguished it is necessary to use the high voltage trigger pulse to re-start the arc. As, previously discussed, the more times a high voltage trigger pulse is applied to a flash lamp, the greater the chances are of premature lamp failure.

SUMMARY OF THE INVENTION

To avoid certain of the disadvantages of operating a flash lamp in the simmer mode, and yet retain the advantages associated therewith, the present invention provides method and apparatus for operating a flash lamp without the use of a high voltage trigger pulse, either to trigger the lamp or to initiate a simmer arc. In accordance with the present invention, the impedance of the flash lamp is lowered by exposing the lamp to radiant energy. The radiant energy excites or ionizes a sufficient quantity of gas molecules in the flash lamp to be fired upon application of a flash voltage. In a presently preferred embodiment, a pulse of radiant energy ignites the lamp to a simmer state just before application of the flash voltage thereby using a minimum amount of energy while providing extended lamp life.

DETAILED DESCRIPTION OF THE PREFERRED EMBODIMENTS

Figure 1:
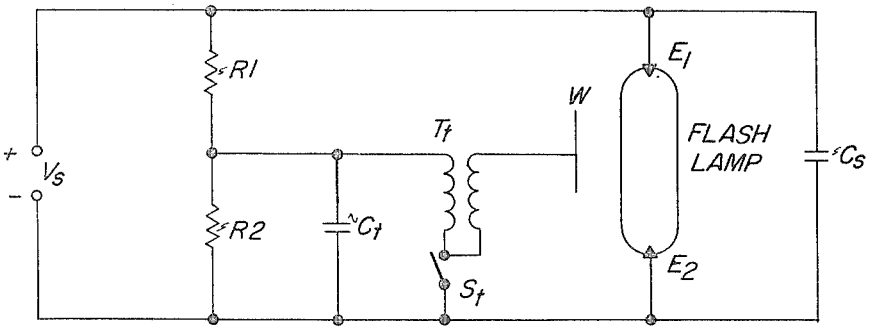
FIG. 1 PRIOR ART
FIGS. 1 and 2 depict electrical circuits which are used to illustrate prior art methods of flash lamp operation.

FIG. 1 shows a circuit for operating a flash lamp with a conventional external trigger. A storage capacitor $C_s$ and a trigger capacitor $C_t$ are charged by a voltage source $V_s$. A pair of resistors R1 and R2 form a voltage divider so that capacitor $C_t$ is charged to its proper potential. A trigger switch $S_t$ is closed and the trigger capacitor $C_t$ discharges through the primary coil of trigger coil $T_t$ thus producing a high voltage pulse in an external trigger wire W connected to the secondary of the trigger transformer $T_t$. The high voltage trigger pulse excites and/or ionizes molecules of gas in the flash lamp which greatly lowers the impedance between the flash lamp electrodes E1 and E2. Once this impedance is lowered, a flash voltage delivered by the storage capacitor $C_s$ discharges through the flash lamp. This $C_s$ discharge causes electron flow which excites some of the electrons of the gas molecules in the flash lamp to a higher energy state, while other electrons are removed completely (ionized) from the gas molecules. When these electrons return to the ground state, energy is released in the form of light which produces the light flash.

Figure 2:
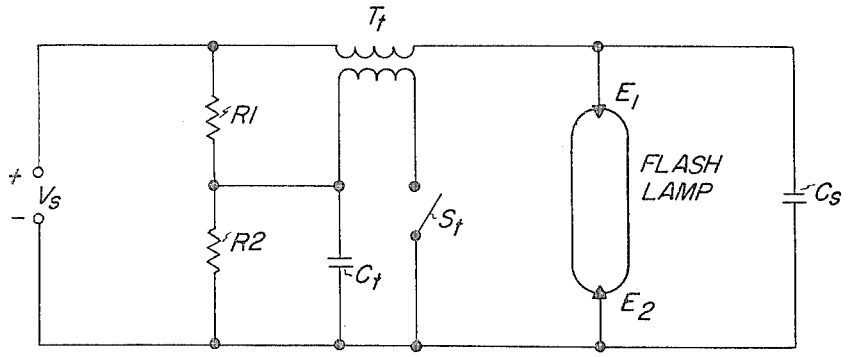
FIG. 2 PRIOR ART

As discussed before, external triggering of the flash lamp suffers from the disadvantages of (1) spurious arcing from the trigger wire W to other components of the flash lamp apparatus, (2) discoloration of the envelope of the flash lamp due to the high voltage applied to the lamp envelope, and (3) relatively poor triggering reliability especially at low trigger voltages. To solve certain of these problems, the flash lamp can be operated in a series-injection mode of operation as illustrated in FIG. 2. The circuit of FIG. 2 is similar to the circuit of FIG. 1 except that, when the trigger switch $S_t$ is closed, the high voltage pulse across the secondary of the trigger transformer $T_t$ is applied directly to the electrode terminals E1 and E2 of the flash lamp. The high voltage pulse across the flash lamp electrodes E1 and E2 produces a strong arc, thereby lowering the impedance between the lamp electrodes E1 and E2 and allowing the charge stored on capacitor $C_s$ to discharge through the flash lamp.

The major difference between the series injection method of operation as shown in FIG. 2 and the external trigger mode of operation shown in FIG. 1 is that the series injection method of triggering does not employ an external trigger wire. But applying the high voltage trigger pulse directly to the lamp electrodes E1 and E2 places extreme stress on these electrodes and may lead to early lamp failure. In actual practice injection triggering adds inductance in the discharge path increasing the time duration of the flash and reducing peak intensity of light output.

In accordance with the present invention a circuit is provided for operating a flash lamp, which circuit does not require the use of an external trigger wire, nor does it require that a high voltage trigger pulse be applied directly to the lamp electrodes. Instead, the impedance of the flash lamp is lowered by applying radiant energy to the flash lamp which excites or ionizes gas molecules within the lamp envelope. The precise wavelength or range of wavelengths which produce optimum results depends, in part, upon the type of gas used in the flash lamp, the gas purity and temperature, and the electrode composition and geometry. It has been found that, for a flash lamp which contains xenon gas molecules, rediation having a wavelength in the range of 0.01 to 300 meters (m) produces satisfactory results. By an appropriate choice of wavelength, intensity, fill pressure and lamp geometry, however, coupling of radiant energy over a wider range of wavelengths may be possible. It is expected that for other inert gases such as krypton, neon, argon, etc., radiant energy of a similar wavelength range would produce the desired impedance drop in the flash lamp.

Figure 3:
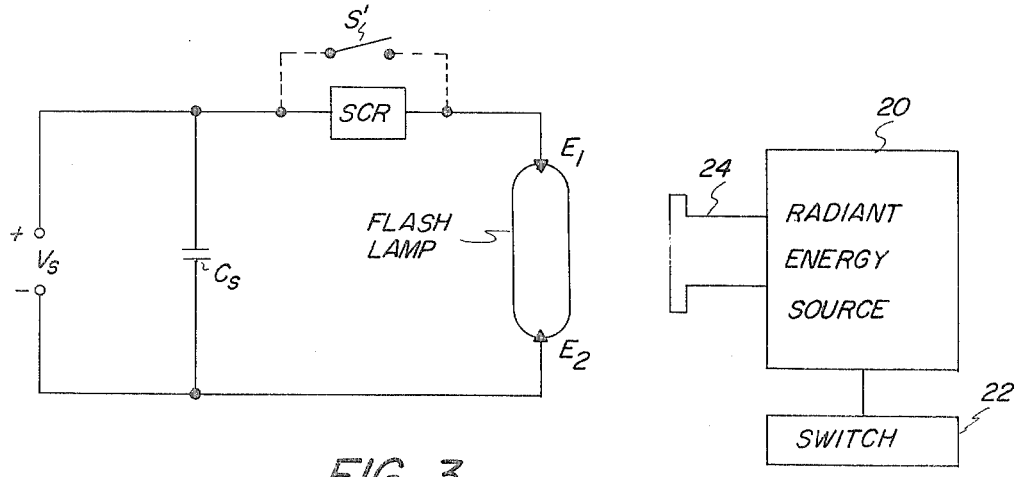
FIG. 3 shows an electrical circuit useful in describing one embodiment of the present invention.

A circuit operating a flash lamp in accordance with the present invention is shown in FIG. 3. A voltage source $V_s$ charges an energy storage device in the form of a storage capacitor $C_s$ which is connected in parallel with a flash lamp. The storage capacitor $C_s$ does not initially discharge through the flash lamp because the flash lamp has near infinite impedance. A source of microwave energy 20 is activated by a switch 22 and the microwave radiant energy thus produced is directed at the flash lamp through a waveguide 24 or other microwave power applicator. The applied microwave radiant energy excites and ionizes gas molecules within the envelope of the flash lamp thereby lowering the impedance between the flash lamp electrodes E1 and E2. A flash voltage from the storage capacitor $C_s$ then discharges through the flash lamp causing the lamp to fire.

As a particular example, an ILC Inc. Flash Lamp No. L-2550 having a 5 mm Bore and a 5 in. arc length was used with a 25 ufd energy storage capacitor $C_s$ charged to 1800 volts by the voltage source $V_s$.

For convenience, a silicon controlled rectifier (SCR) was used to switch the charged energy storage capacitor $C_s$ across the flash lamp electrodes E1 and E2. With the capacitor $C_s$ charged and the SCR switched off, the lamp was inserted into a wave guide conducting microwave radiant energy at a frequency of 2.45 gHz (wavelength of about 0.22 m). When the output of the microwave power supply (represented by radiant energy source 20) was increased to 5 kw, the lamp glowed indicating that a state of ionization had been reached. Upon turning the SCR on, immediate discharge of the energy storage capacitor through the lamp occurred, thereby causing the lamp to flash. A range of microwave power levels was tested showing that lamp placement and microwave power level were interdependent and needed to be properly adjusted to create the desired ionization. It was estimated that microwave power was reduced to as low as 100 watts with proper orientation of the lamp in the wave guide to obtain lamp ignition. It is further believed that the complete range of microwave energy is useful in the practice of the invention, i.e., from 1 meter to 0.01 meter.

Microwave power can be applied to a flash lamp directly in a waveguide, as stated above, or by a microwave fringing field device. To one skilled in the art, it is apparent that various forms of microwave power application devices could be used to direct the radiation into the flash lamp.

In similar fashion, radio frequency energy can be used instead of microwave energy to ignite or trigger a flashlamp. By way of illustration, the same flash lamp was connected across an 8 ufd capacitor charged to 1000 volts. The flash lamp was then triggered by a radio frequency source of approximately 1 megahertz (i.e., wavelength of 300 m). The trigger source was placed at a distance of about 1 cm. from the lamp envelope.

From the above examples, it appears that a wide range of radiant energy wavelengths are useful in practicing the invention. The range apparently extends from at least 0.01 to 300 meters.

The flash lamp shown in FIG. 3 may also be operated in a pulsed mode. A pulse of radiant energy is repetitively applied to the flash lamp by switching the radiant energy source 20 on and off by means of the switch 22. Each time a pulse of radiant energy is applied to the flash lamp, the impedance between the lamp electrodes E1 and E2 is lowered and the flash voltage from an energy storage device (capacitor $C_s$) discharges through the lamp to produce a flash. The pulse rate can conveniently be controlled by the switching rate at which the switch 22 switches the radiant energy source 20 on and off. The capacitor $C_s$ should be allowed sufficient time to charge between radiant energy pulses.

The flash lamp can also be operated in a pulsed mode without switching the radiant energy source 20 on and off. In this type of operation, the radiant energy is continuously applied to the flash lamp to constantly maintained a low impedance between the lamp electrodes E1 and E2. A switch S' represented by dotted lines is used to repetitively apply the flash voltage to the lamp electrodes E1 and E2. The pulse rate at which the lamp flashes is thus controlled by the switching rate at which the switch S' applies the flash voltage.

Figure 4:
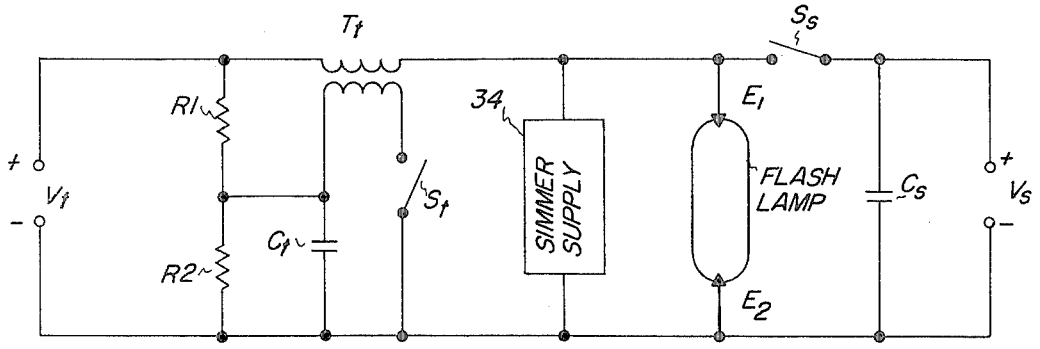
FIG. 4 PRIOR ART
FIG. 4 shows an electrical circuit which illustrates the simmer mode method of flash lamp operation.

The present invention can also be used to advantage in connection with the simmer mode of operation described above. FIG. 4 shows a circuit for operating a flash lamp in a conventional simmer mode. It will be noted that a simmer supply 34 has been added in parallel with the flash lamp. Initially, capacitors $C_s$ and $C_t$ are charged by voltage sources $V_s$ and $V_t$ respectively. When the trigger switch $S_t$ is closed the trigger capacitor $C_t$ discharges through the primary coil of the trigger transformer $T_t$ and produces a high voltage pulse across the secondary coil. This high voltage trigger pulse is applied directly to the electrodes E1 and E2 of the flash lamp and lowers the impedance between the lamp electrodes. Because of the lowered impedance between the electrodes E1 and E2, the simmer supply 34 is able to establish a low current dc arc between the electrodes. Typically, the current of such a simmer arc is on the order of 20–100 ma. When it is desired to flash the lamp, the switch $S_s$ is closed and a flash voltage from the storage capacitor $C_s$ discharges through the lamp producing the lamp flash. Under ideal operating conditions, the simmer arc will not be extinguished upon firing of the flash lamp and the lamp can be repetitively fired by merely closing the switch $S_s$ as the storage capacitor $C_s$ is charged.

Figure 5:
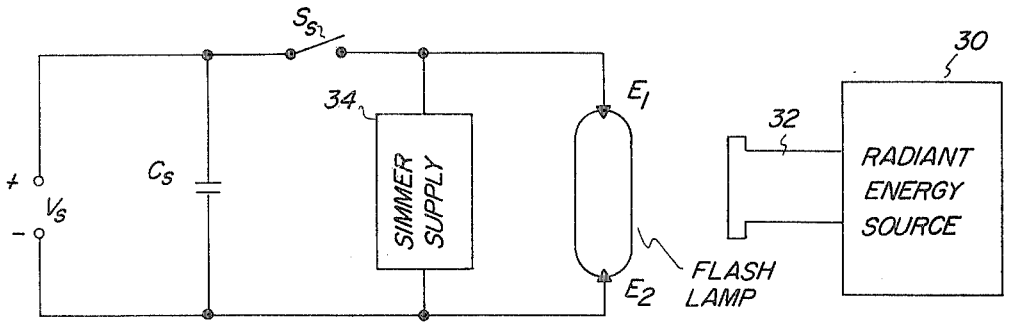
FIGS. 5 and 6 show electrical circuits which illustrate second and third embodiments of the present invention.

To completely eliminate the use of a high voltage trigger pulse and the attendant adverse affects upon lamp life, the present invention provides a circuit shown in FIG. 5 for operating a flash lamp in the simmer mode. A radiant energy source 30 produces radiant energy which is applied to the flash lamp by a waveguide 32. As previously described, the applied radiant energy excites and ionizes gas molecules within the flash lamp envelope thus lowering the impedance between the flash lamp electrodes E1 and E2. A simmer supply 34 then establishes a simmer arc between the lamp electrodes E1 and E2. Firing of the flash lamp is accomplished by closing the switch $S_s$ which allows the storage capacitor $C_s$ to discharge through the flash lamp. In the event that the simmer arc is extinguished, either due to the firing of the flash lamp or because of excessive heat build up, it is a simple matter to retrigger the simmer arc by applying another pulse of radiant energy. Thus, the high voltage trigger pulse which adversely effects lamp life is eliminated entirely.

Because the present invention provides a method of initiating the simmer arc without the use of a high voltage trigger pulse, the flash lamp can now be operated according to a modified simmer mode which consumes much less power and produces substantially less heat. In accordance with the invention, the simmer power supply is purposefully operated so that the simmer arc will be extinguished upon firing of the flash lamp. This can be done by reducing the current of the simmer arc to a marginal value such that the arc is "blown out" upon the main discharge. Alternatively, a switch may be provided in the simmer supply which opens the simmer supply circuit as the flash lamp is discharged. In operation, therefore, a pulse of radiant energy from the radiant energy source 30 is directed at the flash lamp by a waveguide 32. The impedance of the flash lamp is lowered and a simmer arc is established between the flash lamp electrodes E1 and E2. The switch $S_s$ is closed thus allowing the flash voltage on the storage capacitor $C_s$ to discharge through the flash lamp causing the lamp to fire and the simmer arc to be extinguished. The switch $S_s$ is then opened while the capacitor $C_s$ recharges. When it is desired to refire the flash lamp, another pulse of radiant energy from the energy source 30 is applied to the flash lamp to lower the impedance between the electrodes E1 and E2. The simmer arc is thus re-established and the switch $S_s$ can be again closed to cause the storage capacitor $C_s$ to discharge through the flash lamp. Because the simmer arc is not maintained between flashes, less power is used by the simmer supply and less heat is produced by the flash lamp. Importantly, however, because the simmer arc is re-established by means of a pulse of radiant energy rather than a high voltage trigger pulse, lamp life is extended.

Figure 6:
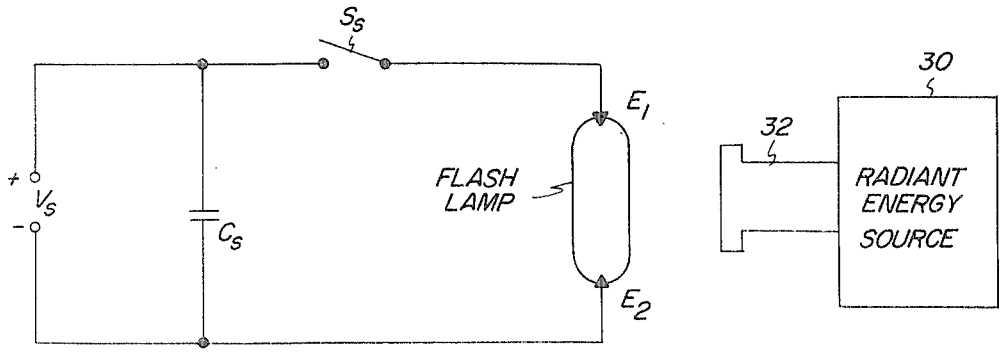

If the power of the radiant energy source 30 is increased, the flash lamp can be operated in the simmer mode without the use of the simmer power supply. It has been found that if the intensity of the radiant energy is sufficiently great, the flash lamp can be made to "simmer" solely under the influence of the applied radiant energy. As shown in FIG. 6, a switch $S_s$ can then be closed to allow the storage capacitor $C_s$ to fire the flash lamp. Because the simmer state is maintained solely under the influence of applied radiant energy, there is no danger that the arc will be extinguished due to the discharge.

The invention has been described in detail with particular reference to preferred embodiments thereof, but it will be understood that variations and modifications can be effected within the spirit and scope of the invention.

What is claimed is:

1. A method of operating a flash lamp in a simmer mode, the flash lamp comprising a pair of electrode in an envelope containing gas molecules, said method comprising the steps of:

applying a simmer voltage to the lamp electrodes;

applying radiant energy to the flash lamp to lower the impedance between the lamp electrodes to allow the simmer voltage to discharge through the flash lamp and establish a simmer arc between the lamp electrodes; and firing the flash lamp by applying a flash voltage to the lamp electrodes which discharges through the flash lamp causing the lamp to fire.

2. A method as claimed in claim 1 wherein the gas molecules are of an inert gas and the wavelength of applied radiant energy is between 0.01 and 300 meters.

3. A method as claimed in claim 1 wherein the gas molecules are of the gas xenon and the wavelength of applied radiant energy is between 0.01 and 300 meters.

4. A method of operating a flash lamp in a simmer mode, the flash lamp comprising a pair of electrodes in an envelope containing gas molecules, said method comprising the steps of:

applying radiant energy to the flash lamp to excite gas molecules in the lamp and lower the impedance between the lamp electrodes;

establishing a simmer arc in the flash lamp by applying a simmer voltage to the lamp electrodes; and firing the flash lamp by applying a flash voltage to the lamp electrodes which discharges through the lamp causing the lamp to fire.

5. A method as claimed in claim 4 wherein the gas molecules are of an inert gas and the wavelength of applied radiant energy is between 0.01 and 300 meters.

6. A method of operating a flash lamp in a pulsed mode, the flash lamp comprising a pair of electrodes in an envelope containing gas molecules, said method comprising the steps of:

repetitively bringing the flash lamp to a simmer state by establishing a simmer arc between the lamp electrodes by applying radiant energy to the flash lamp and applying a simmer voltage to the lamp electrodes; and repetitively applying a flash voltage to the lamp electrodes while the flash lamp is in a simmer state, which voltage discharges through the flash lamp causing the lamp to fire.

7. A method as claimed in claim 6 wherein the gas molecules are of an inert gas and the wavelength of applied radiant energy is between 0.01 and 300 meter.

8. A method as claimed in claim 6 wherein the gas molecules are of the gas xenon and the wavelength of applied radiant energy is between 0.01 and 300 meters.

9. Apparatus for operating a flash lamp in a simmer mode, the flash lamp comprising a pair of electrodes in an envelope containing gas molecules, said apparatus comprising:

a simmer supply for applying a simmer voltage to the lamp electrodes;

a source of radiant energy for applying radiant energy to the flash lamp to lower the impedance between the lamp electrodes to allow the simmer voltage to discharge through the flash lamp and establish a simmer arc between the lamp electrodes; and an energy storage device for firing the flash lamp by applying a flash voltage to the lamp electrodes which discharges through the flash lamp causing the lamp to fire.

10. Apparatus as claimed in claim 9 wherein the gas molecules are of an inert gas and the wavelength of applied radiant energy is between 0.01 and 300 meters.

11. Apparatus as claimed in claim 9 wherein the gas molecules are of the gas xenon and the wavelength of applied radiant energy is between 0.01 and 300 meters.

12. Apparatus for operating a flash lamp in a simmer mode, the flash lamp comprising a pair of electrodes in an envelope containing gas molecules, said apparatus comprising:

a source of radiant energy for applying radiant energy to the flash lamp to excite gas molecules in the lamp and lower the impedance between the lamp electrodes;

means for applying a simmer voltage to the lamp electrodes to establish a simmer arc in the flash lamp; and an energy storage device for firing the flash lamp by applying a flash voltage to the lamp electrodes which discharges through the lamp causing the lamp to fire.

13. Apparatus as claimed in claim 12 wherein the gas molecules are of an inert gas and the wavelength of applied radiant energy is between 0.01 and 300 meters.

14. Apparatus for operating a flash lamp in a pulsed mode, the flash lamp comprising a pair of electrodes in an envelope containing gas molecules, said apparatus comprising:

means for repetitively bringing the flash lamp to a simmer state by establishing a simmer arc between the lamp electrodes by applying radiant energy to the flash lamp and applying a simmer voltage to the lamp electrodes; and an energy storage device for repetitively applying a flash voltage to the lamp electrodes while the flash lamp is in a simmer state, which voltage discharges through the flash lamp causing the lamp to fire.

15. Apparatus as claimed in claim 14 wherein the gas molecules are of an inert gas and the wavelength of applied radiant energy is between 0.01 and 300 meters.

16. Apparatus as claimed in claim 14 wherein the gas molecules are of the gas xenon and the wavelength of applied radiant energy is between 0.01 and 300 meters.

* * * * *